US005123540A

United States Patent [19]

Karavias

[11] Patent Number: 5,123,540

[45] Date of Patent: Jun. 23, 1992

[54] FOLDING LUNCH BOX

[76] Inventor: Barbara Karavias, 153 E. 57th St., #19B, New York, N.Y. 10022

[21] Appl. No.: 596,339

[22] Filed: Oct. 12, 1990

[51] Int. Cl.[5] ..... A45C 11/20

[52] U.S. Cl. ..... 206/546; 206/541; 229/917; 220/337; 220/339

[58] Field of Search ..... 206/541, 546, 548; 220/337, 339; 229/149, 117.02, 117.03, 917, DIG. 4

[56] References Cited

U.S. PATENT DOCUMENTS

| | | | |
|---|---|---|---|
| 110,991 | 1/1871 | Miller | 206/541 |
| 265,796 | 10/1882 | Gernand | 206/541 |
| 362,948 | 5/1887 | Galbreth | 206/546 |
| 2,352,927 | 7/1944 | Whitehead | 206/541 X |
| 3,372,690 | 3/1968 | Ruiz | 206/546 X |
| 4,216,862 | 8/1980 | Daenen | 206/541 |
| 4,235,346 | 11/1980 | Liggett | 229/6 X |
| 4,499,998 | 2/1985 | Carlson | 206/541 |
| 4,509,645 | 4/1985 | Hotta | 206/546 X |
| 4,681,223 | 7/1987 | Roberts | 220/339 X |

*Primary Examiner*—Paul T. Sewell
*Assistant Examiner*—Beth Anne Cicconi
*Attorney, Agent, or Firm*—John B. Dickman, III

[57] ABSTRACT

A collapsible lunch box that can be folded into a flat package for storage when not in use and can be made ready for use by changing the package into a rectangular tube and pivoting two side panels to close the open ends of the tube. The side panels have locking elements which engage openings on the rectangular tube to keep the box closed. In the folded package position the locking elements on the side panels interlock to hold the package in the folded position.

4 Claims, 2 Drawing Sheets

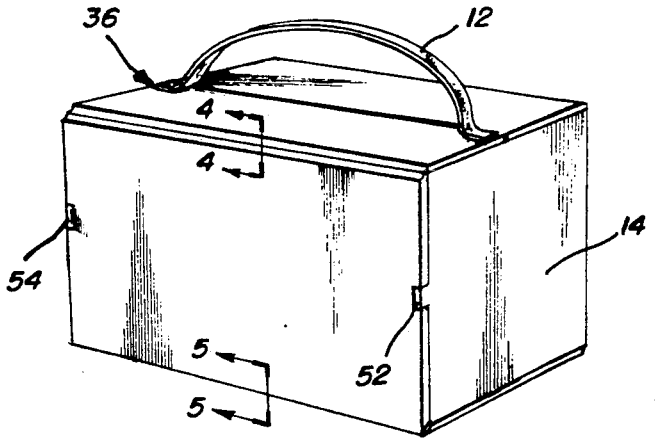
FIG. 1
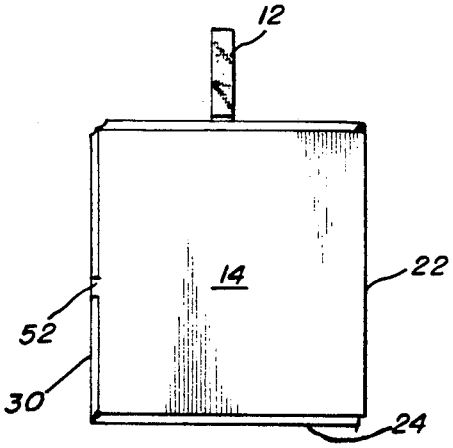
FIG. 2
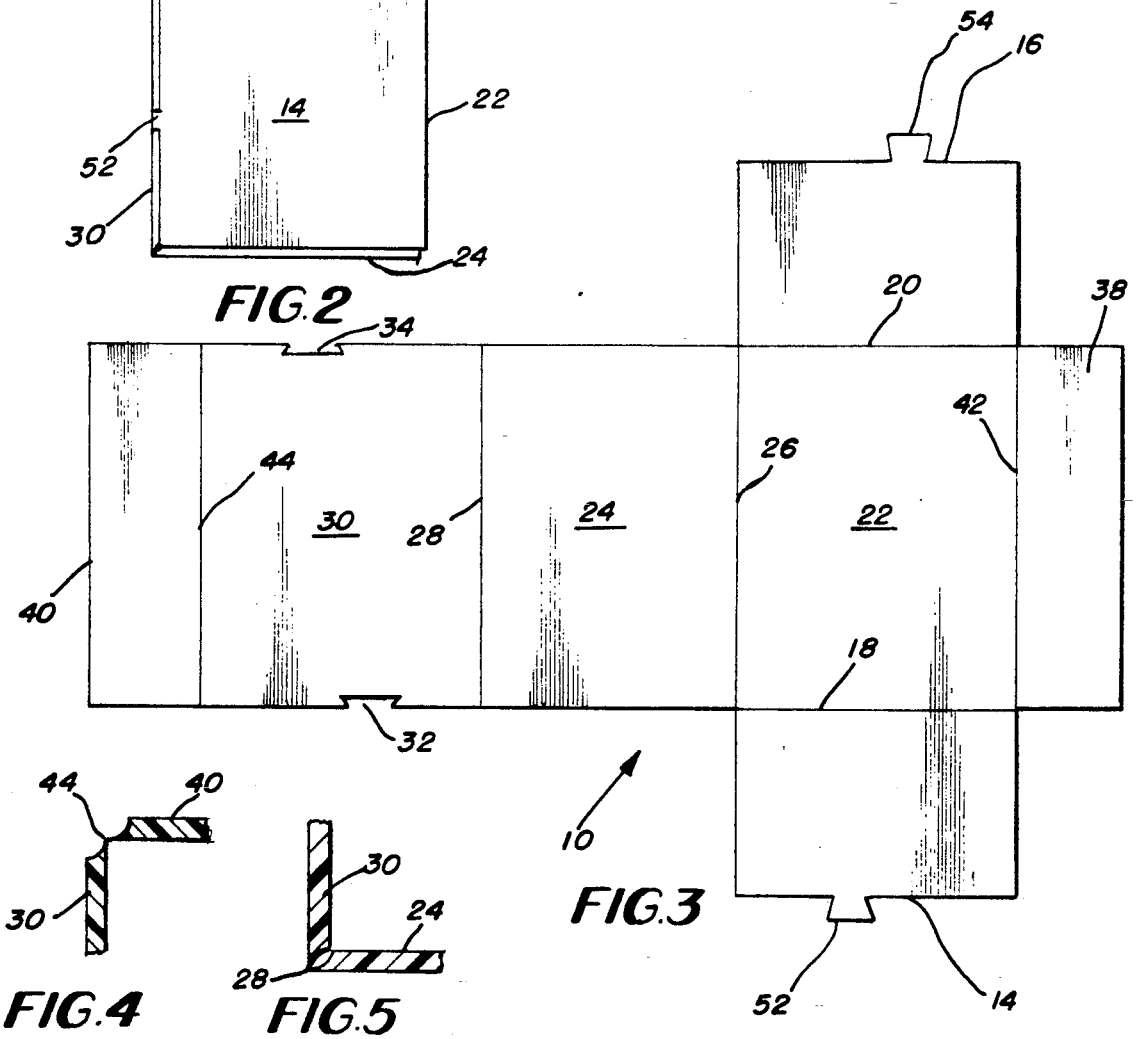
FIG. 3
FIG. 4
FIG. 5

FOLDING LUNCH BOX

BACKGROUND OF THE INVENTION

The present invention relates to a lunch box, and, in particular, a lunch box which is collapsible for storage.

The lunch box or pail, as we know it, has been a companion to school children, office and construction workers for years. They can be seen in every school lunch room, construction sites, on play grounds and high construction beams. The lunch box is as American as apple pie, they represent a hardy meal for those who eat lunch away from home. The problem everyone faces who has ever carried a lunch box is what to do with it after lunch. Because a lunch box is easy to remember before lunch, does not mean that it is rememberable after lunch. In fact, once lunch is over and the lunch box is stored out of the way, it is frequently forgotten and often left until the next day, forcing the child or worker to carry a bag lunch.

The common lunch box or pail is constructed of a stamped tin plate metal that has been painted inside and out and has a carrying handle. There are two popular styles; the first is a flat rectangular box with space for sandwiches, fruit and a thermos, and having a hinged cover; the second style is an upright rectangular box with a hinged domed cover. Sandwiches and fruit are carried in the upright rectangular box, and a thermos is carried in the domed cover.

Since most children carry knap sacks or book bags and construction workers carry tool boxes or equipment bags, it has been realized that some type of collapsible lunch box could be stored in a carry bag which always goes home.

| | | |
|---|---|---|
| U.S. Pat. No. | 265,796 | Gernand |
| | 292,502 | Moran |
| | 362,948 | Galbreth |
| | 3,219,179 | Tuccio |
| | 4,509,645 | Hotta |
| | 4,765,476 | Lee |

The Gernand patent discloses a folding rectangular lunch box made of sheet metal. Each of the panels of the box is hinged to at least one other panel providing the easily foldable lunch box. A wire pintle holds panel to panel and the removal of the pintles from the side panels and the cover allows the box to fold.

Each of the above listed patents, except for Hotta and Lee, shows foldable lunch boxes constructed of plural panels held together by hinges. Hotta shows a one piece box construction with a separate lid. Lee shows an insulated container for carrying beverages.

SUMMARY OF THE INVENTION

It is a primary object of this invention to provide a lunch box for carrying lunch food and is collapsible for easy storage.

Another object of this invention is to provide a lunch box constructed of an inexpensive material and in one form is constructed of a single sheet of material, and in another form can be made by injection molding, blow molding or similar processes.

Still another object of this invention is to provide a lunch box of a durable material that is safe and rugged enough for use by small children.

The present invention is a collapsible lunch box which may be constructed of a single sheet of material, preferably a plastic such as polyethylene, polypropylene or styrene. It is also within the purview of my invention to form the box by injection molding or other suitable means and methods. As with most boxes it has a top, a bottom, a front, a back and two sides. The present box top, bottom, front and back are all hinged together. The two sides are hinged either to the front or back and snap to the other of the front or back to create a closable stable lunch box. The user has the option of carrying disposable packages of beverages, milk, juice and the like, or a rigid thermos, bottles and the like.

DESCRIPTION OF THE DRAWINGS

FIG. 1 is a perspective view of a lunch box of the invention;

FIG. 2 is an end view of a lunch box of FIG. 1 of the invention;

FIG. 3 is a flat plan view of a lunch box of the invention;

FIG. 4 is a cross section of a hinge taken along the line 4—4 of FIG. 2;

FIG. 5 is a cross section of a hinge taken along the line 5—5 of FIG. 2;

DESCRIPTION OF THE INVENTION

Figure 6:
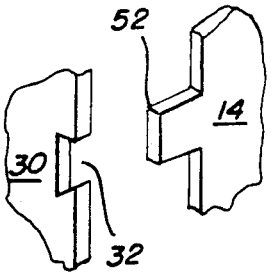
FIG. 6 is a partial perspective view of a closure of the present invention.
Figure 7:
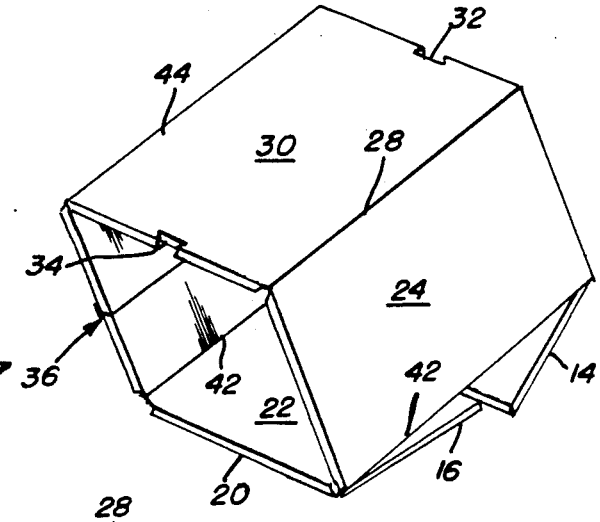
FIG. 7 shows a perspective view of a partially collapsed lunch box.

Referring to the drawings FIGS. 1 to 10, there is shown a lunch box 10 for carrying sandwiches, fruit, a thermos, if desired and other lunch goodies. The assembled lunch box 10, FIGS. 1 and 2, is rectangular in shape with a carrying handle 12. The lunch box 10 has a pair of hinged side panels 14 and 16 for opening and closing the box 10. Because the assembled lunch box 10 is dependent on one or both side panels 14 and 16 for supporting the rectangular shape, one of the side panels should be in the closed position of FIGS. 1 or 2.

FIG. 3 shows an unassembled plan of a lunch box 10 of this invention. The side panels 14 and 16 are integrally hinged at 18 and 20, respectively, to a back panel 22. Hinged to the back panel 22 is a bottom panel 24. Again, an integral hinge 26 secures bottom panel 24 to back panel 22. A second integral hinge 28 connects bottom panel 24 to a front panel 30. Front panel 30 has a pair of notches or slots 32 and 34, respectively, which will be explained later. The lunch box has a top panel 36 which is made of two half panels 38 and 40. Half panel 38 has an integral hinge 42 which connects panel 38 to back panel 22. While half panel 40 has an integral hinge 44 for connecting the panel 40 to front panel 30. When the panels 22, 24, 30 and half panels 38 and 40 are folded to form a rectangular tube, the half panels 38 and 40 butt together.

Figure 8:
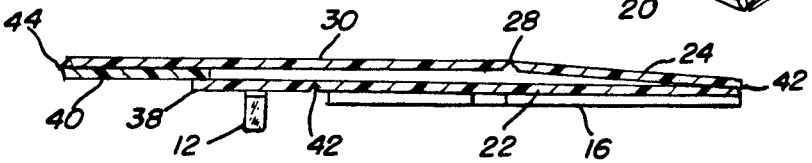
FIG. 8 is a side view of a completely collapsed lunch box.

The rectangular tube formed by the panels 22, 24, 30 and 36 and the connecting hinges 26, 28, 42 and 44 is collapsible as a parallelogram into a flat package. The flat package, shown in FIG. 8, is made possible by the integral hinges 26, 28, 42 and 44. Alternate hinges are similar, that is, hinges 26 and 44 pivot in one direction while hinges 28 and 42 pivot in the opposite direction, to create the rectangular shape or a flat package.

The different type hinges are shown in FIGS. 4 and 5. The outside hinge 44 of FIG. 4 is a carved U-shaped groove which can pivotally bring panels 30 and 36 together. Inside hinge 28 also has a carved U-shaped groove that can pivotally open to move panels 24 and 30 from the ninety degree angle of FIG. 5 to the one hundred eighty degree angle of FIG. 8. As mentioned, hinges 44 and 26 are the same, and hinges 28 and 42 are the same.

Side panels 14 and 16 are integrally hinged to back panel 22 via hinges 18 and 20, respectively. Hinges 18 and 20 are inside hinges just like hinges 28 and 42, which permits the side panels 14 and 16 to pivot 270 degrees from the ninety degree angle with the back panel 22 as shown in FIG. 8.

The side panels 14 and 16 have projections o tabs 52 and 54, respectively, as shown in FIGS. 1 and 3. The tabs 52 and 54 mate with slots 32 and 34, respectively, to form a locking means for the side panels. FIG. 6 shows the locking arrangement of the tab 52 and slot 32. Slot 32 is shown slightly dove tailed to give the locking arrangement a friction grip that prevents inadvertent opening of the side panels. It is contemplated that other suitable types of locking means may be used as desired.

In another form, an overlapping flange is formed around the inner peripheral edge of said box and a mating recessed portion on the end flap provided for additional strengthening of the whole box when closed. Also the mating flanges keep out dust, dirt, etc.

Figure 11:
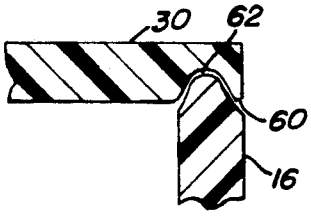
FIG. 11 shows a sealing engagement for a collapsible lunch box of this invention.
Figure 12:
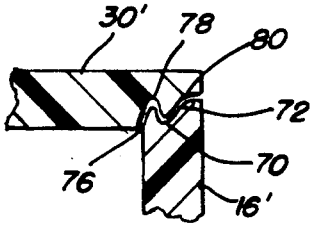
FIG. 12 shows another embodiment of a sealing engagement of this invention.

The side panels 14 and 16 have projections as shown in FIGS. 11 and 12 to engage recesses near the end of panels 24, 30 and 36. Looking at FIG. 11 the side panel 16 has arcuate shaped cross section 60 on its ends which snaps into an arcuate recess 62. The outside edge 64 of arcuate recess 62 is shorter than inside edge 66 to permit the side panel 16 to easily snap into recess 62. The inside edge 66 is pressed against the arcuate end 60 to seal the lunch box 10 against water and dust.

In FIG. 12, another embodiment of a side panel 16' has a recess 70 with a shoulder 72 and an inside lip 74. The panel 30 has a projection 76 which fits in recess 70, and a recess 78 which fits in inside lip 74. There is also an outside depression 80 that cooperates with shoulder 72 to form an effective seal against water and dust.

Figure 13:
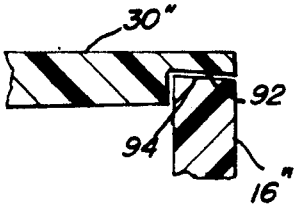
FIG. 13 shows a third embodiment of a sealing engagement of this invention.

It should be understood that while sealing arrangements of FIGS. 11, 12 and 13 seal against water and dust, they also aid in holding the side panels in place. However, the locking tabs 52 and 54 are necessary for locking the panels 14 and 16 in place.

Another embodiment of the edge sealing feature is shown in FIG. 13 where panel 30'' has a recess 90 with an inwardly slanted inclined surface 92 and side panel 16'' has a beveled end with an outwardly slanted inclined surface 94. The angles of inclined surfaces 92 and 94, while slanting in the opposite directions, are the same. Mating of the inclined surfaces 92 and 94 form a water and dust seal.

Figure 9:
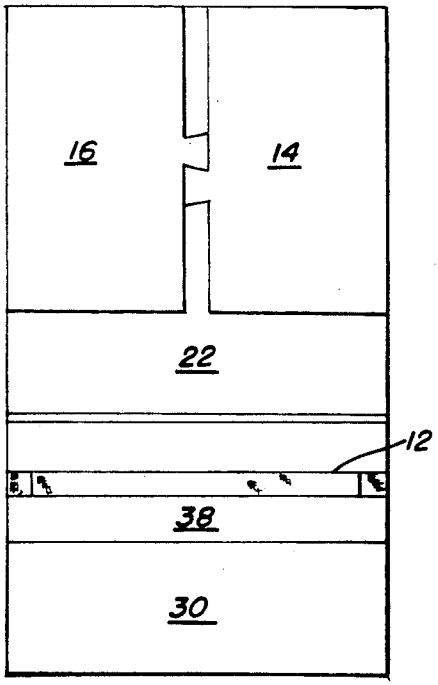
FIG. 9 is a plan view showing a folded lunch box of this invention.

The folded lunch box shown in FIG. 9 has the tabs 52 and 54 interlocked to hold the side panels 14 and 16 against the back panel. When the side panels 14 and 16 are pivoted to lay flat against the back panel 22 the tabs 52 and 54 frictionally engage. As the side panels are pressed down, the frictional engagement increases to hold the panels in place.

Figure 10:
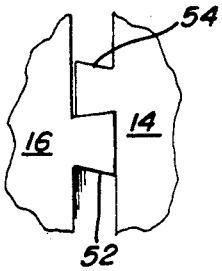
FIG. 10 is a partial plan view showing of a folded lunch box of this invention.

In FIG. 10 the tabs 52 and 54 are shown offset and having dove tail shapes for better frictional engagement.

In use, the assembled lunch box 10 is opened by prying open one of the side panels 14 or 16. Lunch food is either inserted or removed from the lunch box, depending upon the activity required. Should it be lunchtime, and the food has been removed, both panels are opened and the front panel is pressed own as in FIG. 8. The side panels 14 and 16 are folded under to complete the folded package. Setting the lunch box 10 up is done by reversing the procedure. In the folded package position, the lunch box is easily stored in a book bag etc. for taking home.

While only one embodiment of the invention has been shown, it is understood that one skilled in the art may realize other embodiments of the invention. Therefore, one should look to the drawings, description and claims for a full understanding of the invention.

I claim:

1. A collapsible lunch box for easy storage when not in use that can be set up for carrying food and drink by forming a rectangular tube with closing panels comprising:

a collapsible rectangular tube having a front panel, a back panel, a bottom panel and a top panel connected by hinge means to allow said rectangular tube to collapse as a parallelogram;

a pair of side panels hinged to said back panel, where said side panels are pivotal to fold flat against said back panel when said rectangular tube is folded flat;

a locking arrangement for securing said side panels to said front panel, said locking arrangement including projection means on said side panels and slot means on said front panel means, whereby said projection means engage and frictionally lock with said slot means;

said projection means on each of said side panels interlock with each other to hold said side panels against said back panel when said rectangular tube is folded flat;

a handle mean son said top panel for carrying said lunch box, and said rectangular tube and said side panel being formed from a sheet of material.

2. A collapsible lunch box as in claim 1, wherein said panel means forming said rectangular tube includes inside surfaces and edges having arcuate recesses along said inside surfaces adjacent said edges, and said side panel means having arcuate ends for being received in said arcuate recesses of said panel means, where said arcuate recesses have outside lips shorter than an inside wall of said arcuate recesses to permit said arcuate projections to snap in said arcuate recesses and seal said lunch box.

3. A collapsible lunch box as in claim 1, wherein said panel means forming said rectangular box has inside walls and edges, arcuate projections with outside walls which are concave along said edges of said panel means and inside walls extending into recesses, and said hinged side panels having edges with arcuate recesses for fitting in said arcuate projections, where said arcuate recesses have outside convex walls to match said concave walls of said arcuate projections and inside walls ending in lips for fitting in said depressions of said arcuate recesses.

4. A collapsible lunch box as in claim 1, wherein said rectangular tube having inside surfaces and edges where recesses with inwardly inclined surfaces extend along said inside surfaces adjacent said edges, and said side panel means having edges with outwardly inclined surfaces to cooperate with said inwardly inclined surfaces on said rectangular tube.

* * * * *